US008479959B2

(12) United States Patent
Evans et al.

(10) Patent No.: US 8,479,959 B2
(45) Date of Patent: Jul. 9, 2013

(54) DEVICE FOR LIFTING, SUPPORTING, TRANSPORTING AND UNLOADING A KAYAK OR CANOE

(76) Inventors: Brian David Evans, Nova Scotia (CA); Gregory Howard Evans, Nova Scotia (CA)

( * ) Notice: Subject to any disclaimer, the term of this patent is extended or adjusted under 35 U.S.C. 154(b) by 589 days.

(21) Appl. No.: 12/286,683

(22) Filed: Oct. 1, 2008

(65) Prior Publication Data

US 2009/0126620 A1 May 21, 2009

(30) Foreign Application Priority Data

Nov. 19, 2007 (CA) ..... 2611228

(51) Int. Cl.
*A45F 5/00* (2006.01)

(52) U.S. Cl.
USPC ..... 224/265; 224/185; 224/189; 224/201; 224/272

(58) Field of Classification Search
USPC ..... 224/185, 189, 201, 265–266, 272; 248/125.2, 354.3; 211/105.4
See application file for complete search history.

(56) References Cited

U.S. PATENT DOCUMENTS

| | | | | |
|---|---|---|---|---|
| 2,671,231 | A * | 3/1954 | Massicotte | 114/347 |
| 3,347,543 | A * | 10/1967 | Zak | 269/296 |
| 3,375,960 | A * | 4/1968 | Stevens et al. | 224/42.11 |
| 3,734,367 | A * | 5/1973 | Jackson | 224/262 |
| 4,304,078 | A * | 12/1981 | Meriwether, Jr. | 52/127.2 |
| 4,641,874 | A * | 2/1987 | Grenzer | 294/15 |
| 4,649,846 | A * | 3/1987 | Javanelle | 224/181 |
| 5,495,968 | A * | 3/1996 | Miller | 224/266 |
| 5,577,457 | A * | 11/1996 | Nichols, Jr. | 114/343 |
| 6,019,263 | A * | 2/2000 | Palmer | 224/261 |
| 6,233,877 | B1 * | 5/2001 | Monroe | 52/37 |
| 6,681,968 | B2 * | 1/2004 | Zwagerman | 224/153 |
| 7,385,125 | B2 * | 6/2008 | Motsenbocker | 84/292 |
| 7,562,635 | B1 * | 7/2009 | Morris | 114/347 |
| 2002/0030073 | A1 * | 3/2002 | Duval et al. | 224/266 |

FOREIGN PATENT DOCUMENTS

CA 1197733 A * 12/1985

* cited by examiner

*Primary Examiner* — Justin Larson
*Assistant Examiner* — John Cogill
(74) *Attorney, Agent, or Firm* — Frank J. Bonini, Jr.; John F. A. Earley, III; Harding, Earley, Follmer & Frailey, P.C.

(57) ABSTRACT

A device for lifting, supporting, transporting and unloading a kayak, comprising, engagement means for releasably and securely engaging the coaming of the kayak support means for stably supporting the engagement means and engaged kayak on an individual's shoulders and rotation means in engagement with the support means and the engagement means adapted to rotate the engagement means relative to the support means.

7 Claims, 7 Drawing Sheets

DEVICE FOR LIFTING, SUPPORTING, TRANSPORTING AND UNLOADING A KAYAK OR CANOE

BACKGROUND OF THE INVENTION

1. Field of the Invention

The present invention relates to a device for lifting, supporting, transporting and unloading a kayak or canoe, and more particularly, relates to a device for lifting, supporting, transporting and unloading a kayak or canoe which may be temporarily attached to the kayak or canoe for assisting an individual in the lifting, supporting, transporting and unloading of the kayak or canoe on or from the individual's shoulders.

2. Background of the Invention

Moving a kayak over uneven ground from one location to another presents many difficulties. For example, prior to launching a kayak into the water, it is often necessary to move it a significant distance from a motor vehicle to the water for launching. Where only one person (referred to herein as an "individual") is available to manipulate, lift and carry the kayak, that individual may, with some difficulty, effort and risk of injury to the individual, the kayak and the surrounding environment, lift the kayak on edge, by the coaming, and position it so that one side of the coaming rests on the individual's shoulder near the neck, placing the entire load a significant distance to one side of the spine, and thereafter transport the kayak. Such a method of carrying the load is inherently unstable, uncomfortable and poses a risk of spinal injury. This risk of injury is greatly increased during the lifting and twisting motion involved in raising the kayak to, and lowering from the shoulder position.

It is desirable to have a device which may be temporarily and readily attached to, and detached from a kayak or canoe, and which assists an individual in the lifting, supporting, transporting and unloading of the kayak or canoe. It is also desirable to have a device which reduces the risk of injury to the individual, the kayak, and the surrounding environment, when the kayak is being lifted, supported, transported and unloaded. It is also desirable to have a device which is light, corrosion resistant, reliable, inexpensive and easy to assemble and dismantle and which may be readily stowed in a small space (such as in the bulkhead of the kayak) prior to and subsequent to use. Additionally it is desirable to have a device which permits an individual to transport a loaded kayak (being supported by the individual by way of the device), without requiring that the individual utilize their hands during the transporting process, the individual's hands being free to carry other objects or to perform other functions as needed.

SUMMARY OF THE INVENTION

Accordingly, one object of the present invention is to provide a device which may be temporarily and readily attached to, and subsequently detached from a kayak or canoe, and which assists an individual in the lifting, supporting, transporting and unloading of the kayak or canoe.

Accordingly, another object of the present invention is to provide a device which reduces the risk of injury to the individual, the kayak, and the surrounding environment, when the kayak is being lifted, supported, transported and unloaded.

Accordingly, another object of the present invention is to provide a device which is light, corrosion resistant, reliable, inexpensive and easy to assemble and dismantle and which may be readily stowed in a small space prior to and subsequent to use.

Accordingly, another object of the present invention is to provide a device which permits an individual to transport a kayak (being supported by the individual by way of the device), without requiring that the individual utilize their hands during the transporting process, the individual's hands being free to carry other objects or to perform other functions as needed.

According to one aspect of the present invention, there is provided a device for lifting, supporting, transporting and unloading a kayak, comprising, engagement means for releasably and securely engaging the coaming of the kayak, support means for stably supporting the engagement means and engaged kayak on an individual's shoulders and rotation means in engagement with the support means, the engagement means adapted to rotate the engagement means relative to the support means.

Advantageously, the present invention provides a device which may be temporarily and readily attached to, and subsequently detached from a kayak or canoe, and which assists an individual in the lifting, supporting, transporting and unloading of the kayak or canoe.

A further advantage of the present invention is that it provides a device which reduces the risk of injury to the individual, the kayak, and the surrounding environment, when the kayak is being lifted, supported, transported and unloaded.

A further advantage of the present invention is that it provides a device which is light, corrosion resistant, reliable, inexpensive and easy to assemble and dismantle and which may be readily stowed in a small space prior to and subsequent to use.

A further advantage of the present invention is that it provides a device which permits an individual to transport a kayak (being supported by the individual by way of the device), without requiring that the individual utilize their hands during the transporting process, the individual's hands being free to carry other objects or to perform other functions as needed.

BRIEF DESCRIPTION OF THE DRAWINGS

A preferred embodiment of the present invention is described below with reference to the accompanying drawings, in which.

DESCRIPTION OF THE PREFERRED EMBODIMENT

Figure 1:
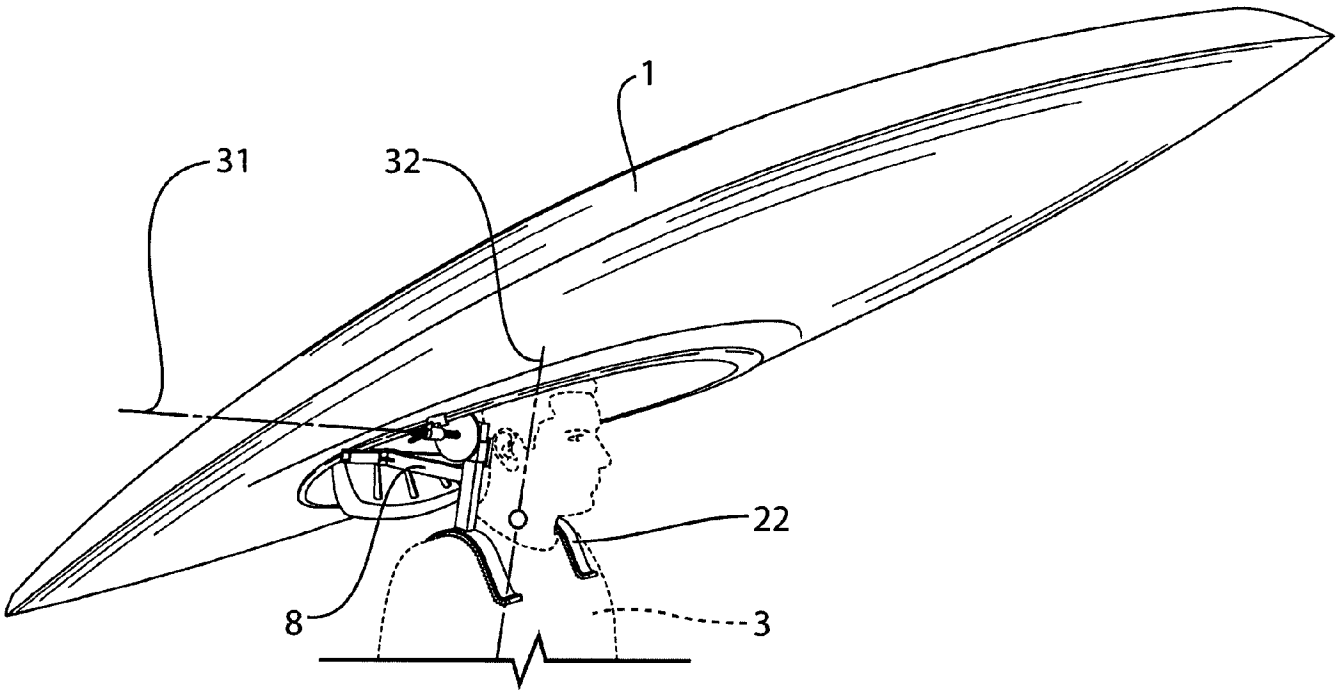
FIG. 1 is a view of an individual supporting a kayak utilizing a device of one embodiment of the present invention.
Figure 1:
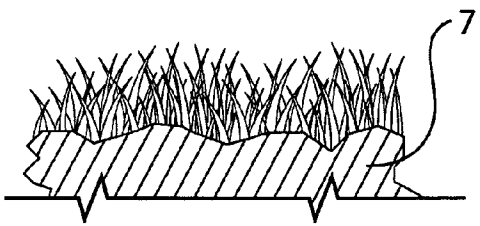
Figure 3:
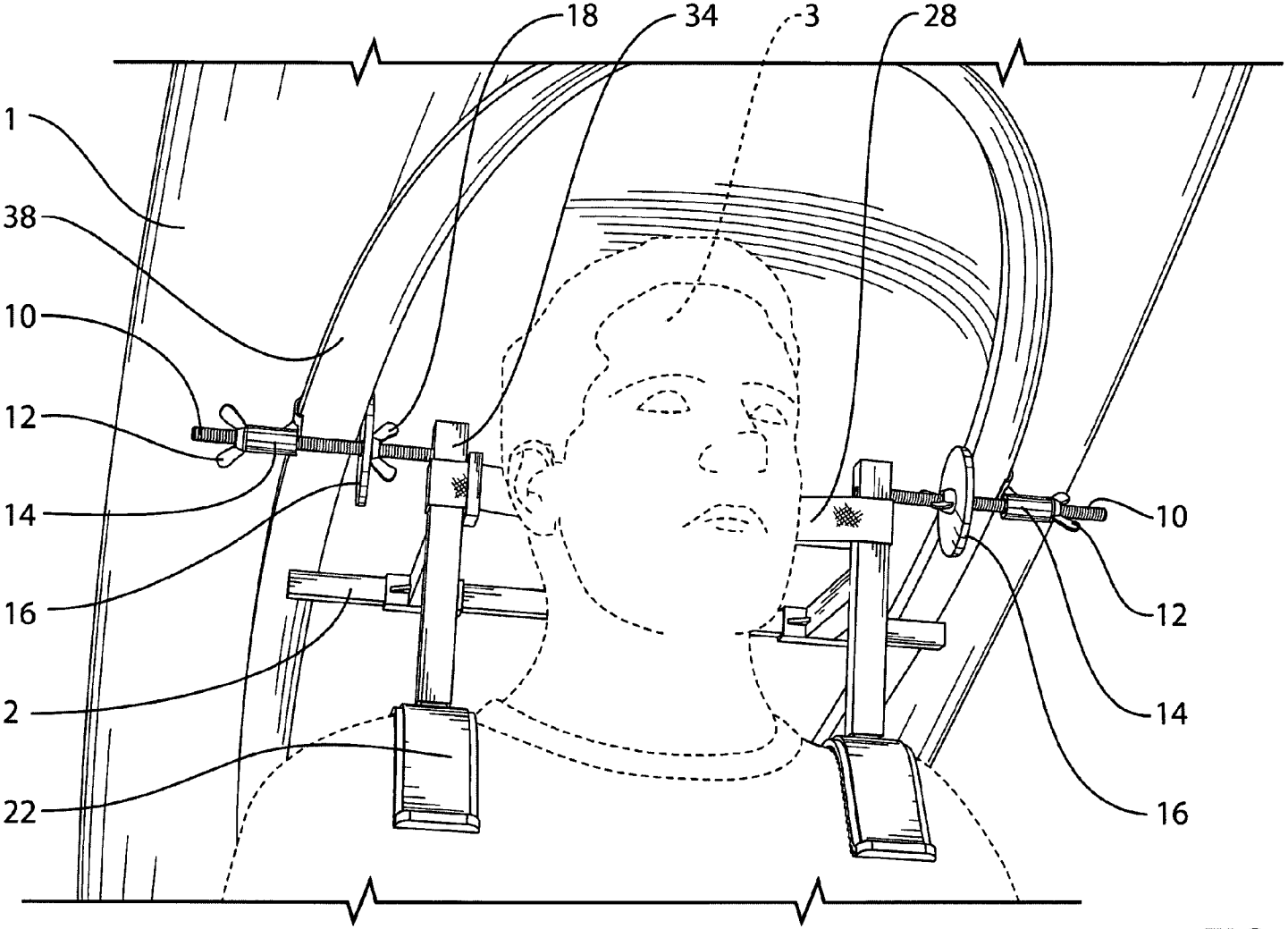
FIG. 3 is a view of the device of one embodiment of the present invention installed on a kayak and being supported by an individual.
Figure 6:
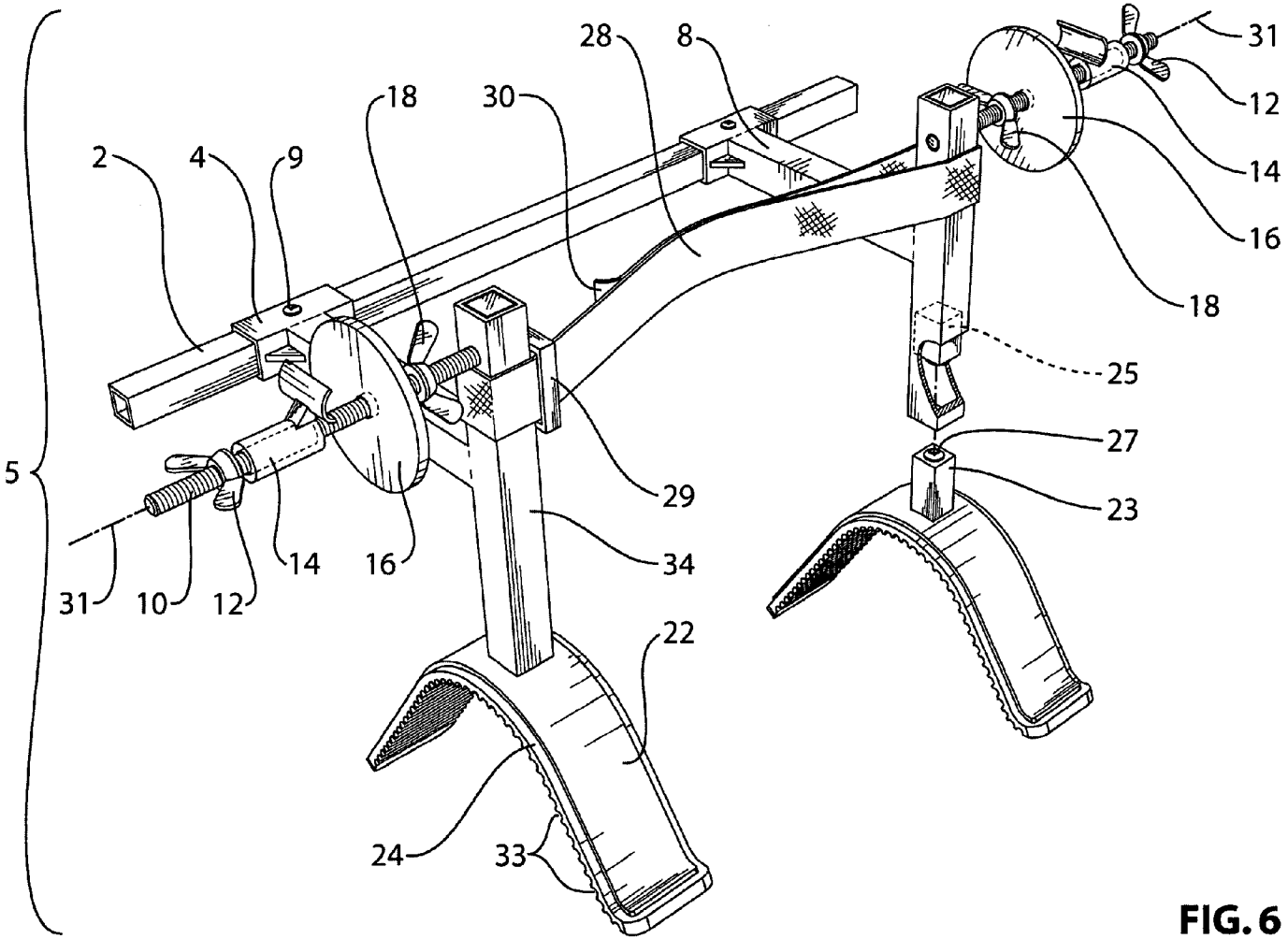
FIG. 6 is a perspective view, partially in ghost, of the device of one embodiment of the present invention.

As illustrated in FIGS. 1, 3 and 6, a kayak or canoe 1 (hereinafter both a kayak and canoe are referred to herein as a "kayak" or "kayaks" unless otherwise specifically indicated) is supported above an individual 3 by the device of the present invention (generally shown as 5 in FIG. 6), the device 5 preferably having a pair of clamps (generally shown as 14 and 16 in FIG. 3) which may be temporarily and securely engaged with the coaming/gunwale 38 on both sides of the kayak 1 as more fully described herein.

In the preferred embodiment of the present invention, each of the clamps 14 and 16 has an outer clamp support 14, having a preferably concave-shaped outer clamp element 37 adapted to engage with an outer surface of the coaming/gunwale 38 as illustrated in FIGS. 3, 5, 6 and 7, the concave-shaped outer clamp element 37, being preferably welded or otherwise securely fastened to the outer clamp support 14, which outer clamp support 14 has a non-threaded hole 15 preferably through and along the longitudinal axis thereof and positioned upon a preferably threaded load carrying rod 10 as more fully described herein, each of the clamps also having a preferably disk-shaped inner clamp element 16 having a non-threaded hole 17 therethrough and also positioned upon the load carrying rod 10 as more fully described herein. The non-threaded hole 15 through the longitudinal axis of the outer clamp support 14 allows the outer clamp support 14 (and concave-shaped outer clamp element 37) to move in both directions along (as illustrated by the arrows 68 in FIG. 4), and rotate in relation to (as illustrated by the arrows 66 in FIG. 4) the load carrying rod 10 when positioning and fastening the outer clamp to the outer surface of the coaming/gunwale 38 as more fully described herein, and allows the outer clamp support 14 (and concave-shaped outer clamp element 37) to rotate in relation to the load carrying rod 10 once the coaming/gunwale 38 has been fastened in the clamps 14 and 16 as more fully described herein. Similarly, the non-threaded hole 17 through the inner clamp element 16 allows the inner clamp element 16 to move along the load carrying rod 10 (as illustrated by the arrows 72 in FIG. 4) when positioning and fastening the inner clamp element 16 to the inner surface of the coaming/gunwale 38 as more fully described herein, and to rotate in relation to the load carrying rod 10 (as illustrated by the arrows 70 in FIG. 4) once the coaming/gunwale 38 has been fastened in the clamps 14 and 16 as more fully described herein.

Figure 4:
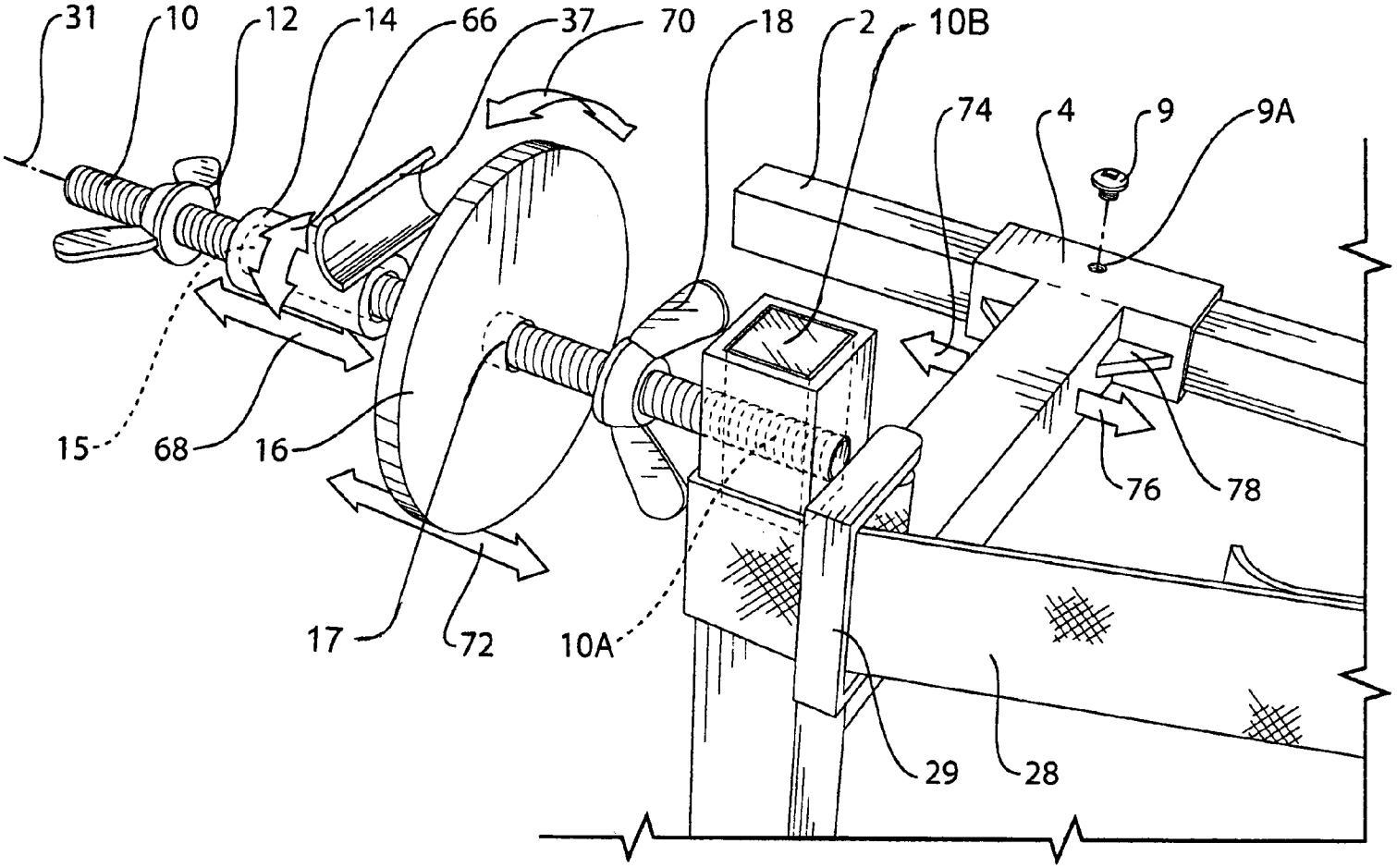
FIG. 4 is an enlarged view, partially in ghost, of a portion of the device of one embodiment of the present invention.

In the preferred embodiment of the present invention, main upright posts 34 are provided, which are preferably made of square aluminum tubing which forms the main upright post 34 (it being understood that in alternative embodiments of the present invention, alternative materials of various configurations may be utilized in a manner known to a person skilled in the art). In one embodiment of the present invention, an aluminum reinforcing plug 10B is provided, which has been welded or otherwise securely fastened to the interior of the square aluminum tubing which forms the main upright post 34 as illustrated in FIG. 4, which provides additional structural strength to the main upright post 34 at the point of attachment of the load carrying rods 10 as more fully described herein. In the preferred embodiment of the present invention, each of the load carrying rods 10 is securely threadingly engaged with, or alternatively welded or otherwise securely fastened to the main upright posts 34 as illustrated in FIG. 4 (which illustrates the threaded load carrying rod 10, inserted into a corresponding threaded hole 10A through the walls of the square aluminum tubing which forms the main upright post 34, and through the reinforcing plug 10B).

Figure 5:
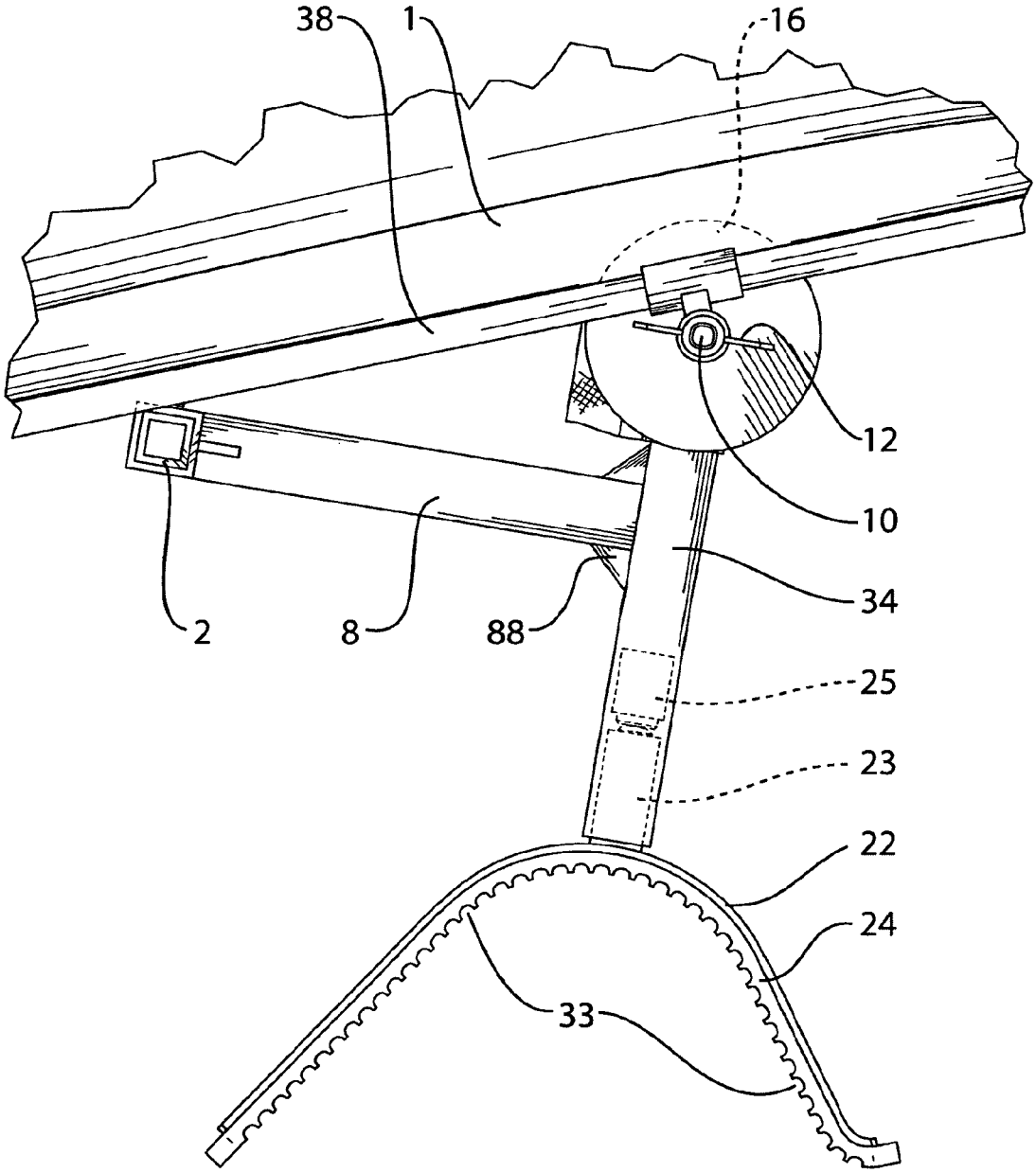
FIG. 5 is a side view, partially in ghost, of a portion of the device of the present invention attached to the gunwale/coaming of a kayak.

In the preferred embodiment of the present invention, two shoulder mounts 22 are provided which are preferably shaped to conform or substantially conform to the shape of an individual's shoulders, each of which shoulder mounts 22 is securely and preferably disengagably (as described hereinafter) attached to a corresponding main upright post 34 as illustrated in FIG. 5, the shoulder mounts preferably having a layer of soft rubber foam 24 or other suitable material glued or otherwise securely attached to the inner surface thereof to allow the shoulder mounts 22 to rest comfortably and securely on the individual's shoulders. In the preferred embodiment of the present invention, deep horizontal cuts or ridges 33 are provided in the exposed surface of the layer of soft rubber foam 24 padding to increase grip on the individual's shoulders during use, and to reduce slippage, particularly during the lifting and unloading of the kayak (in alternative embodiments of the present invention, various different surface formations may be provided on the exposed surface of the layer of soft rubber foam 24 to increase the grip on the individual's shoulders as would be known to a person skilled in the art).

Figure 7:
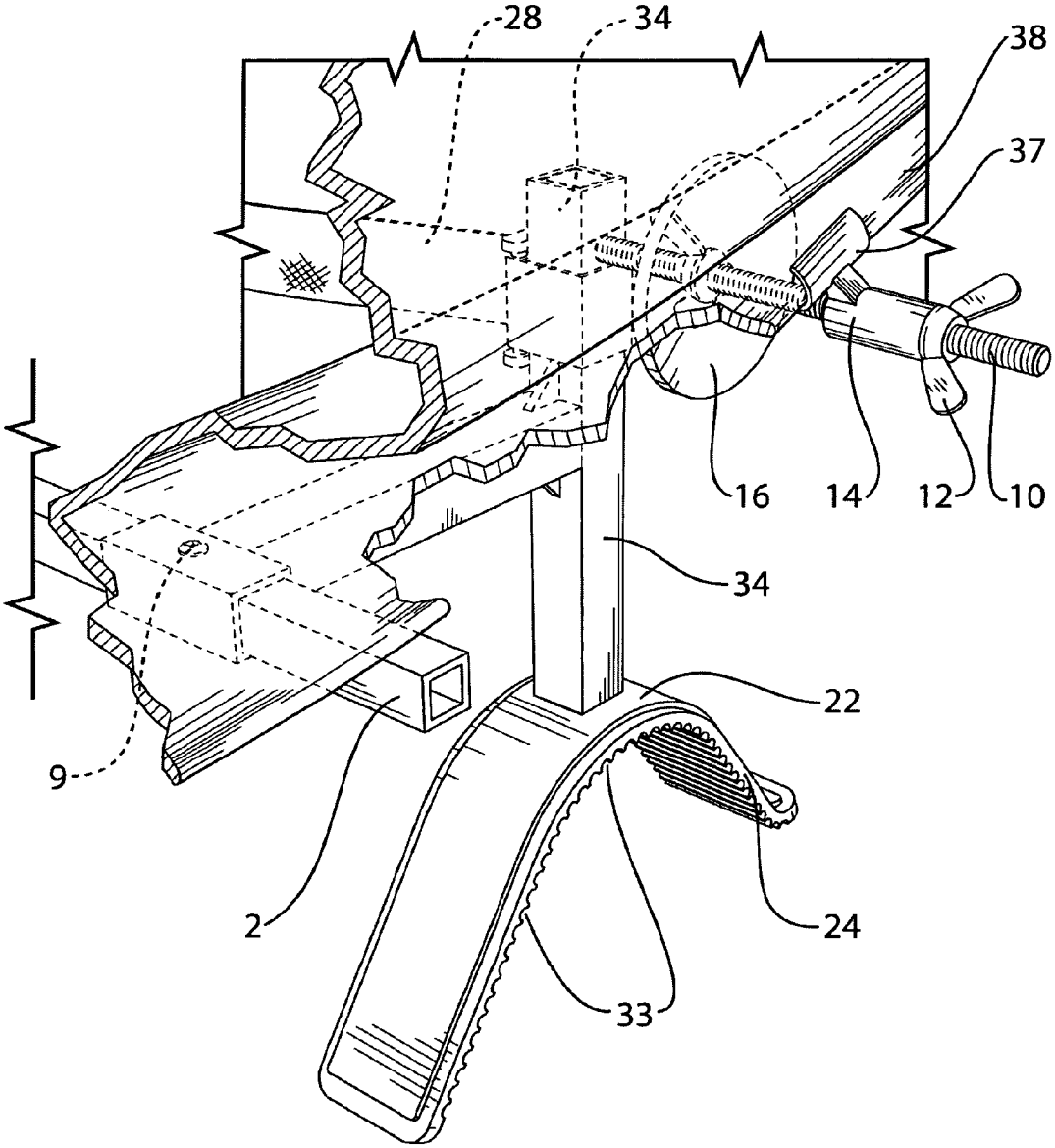
FIG. 7 is a rear and side view, partially in ghost, of a portion of the device of one embodiment of the present invention attached to the gunwale/coaming of a kayak.

In the preferred embodiment of the present invention, a setback bar 8 is preferably welded or otherwise securely attached to each of the main upright posts 34, each of the setback bars 8 having preferably welded or otherwise securely attached thereto, a balance bar adjusting sleeve 4 into which balance bar adjusting sleeves 4 a balance bar 2 may be inserted, as illustrated in FIGS. 3, 4, 5, 6, and 7, the inner dimensions of the balance bar adjusting sleeves 4 being slightly larger than the outer dimensions of the balance bar 2 to allow the balance bar 2 to be securely and closely fitted within and in sliding engagement with the interior sleeve walls of the balance bar adjusting sleeves 4. In one embodiment of the present invention, as illustrated in FIGS. 4, 5 and 7, gussets 88 may be provided to strengthen the joint between the setback bar 8 and the main upright posts 34 and additional gussets 78 may be provided to strengthen the joint between the setback bar 8 and the balance bar adjusting sleeve 4.

In the preferred embodiment of the present invention, as illustrated in FIG. 4, a screw 9 inserted in a threaded hole 9A in each of the balance bar adjusting sleeves 4, may be tightened to temporarily and securely position the balance bar adjusting sleeve 4 relative to the balance bar 2, and may be loosened to allow the movement of the balance bar adjusting sleeve 4 relative to the balance bar 2 as illustrated by the arrows 74 and 76 in FIG. 4. In this way, the relative distance between the balance bar adjusting sleeves 4 (and correspondingly, the relative distance between the shoulder mounts 22) may be adjusted so that the relative distance between the shoulder mounts 22 may be adjusted to suit the individual's comfort, and, once adjusted, the screws 9 on each of the balance bar adjusting sleeves 4 may be tightened to temporarily lock into position the balance bar adjusting sleeves 4 and correspondingly, the relative position of the shoulder mounts 22. It is understood that the preferred embodiment of the present invention has been described with reference to the utilization of screws 9 within threaded holes 9A to permit or restrict the movement of the balance bar 2 relative to the balance bar adjusting sleeves 4. In alternative embodiments of the present invention, alternative devices and mechanisms may be utilized to achieve this function as would be known to a person skilled in the art.

In the preferred embodiment of the present invention, an adjustable head strap 28 is provided, as illustrated in FIGS. 3, 4 and 6, the head strap 28 being preferably made of woven nylon or other material known to a person skilled in the art, and preferably being buckled 29, looped around or loosely attached to the main upright posts 34 as illustrated in FIG. 6, the head strap 28 preferably having a Velcro® hook and loop fastener system 30 sewn or otherwise affixed in two suitable locations to allow for a rapid and secure but temporary engagement of an end of the head strap 28 to one another surface of the head strap 28 in a manner known to a person skilled in the art, to thereby permit a shortening or lengthening of the head strap 28 to suit the individual's physical characteristics and preferences. It is understood that alternative materials may be utilized for fabricating the head strap 28, that alternative means for fastening the head strap to the main upright posts 34 may be utilized, and that alternative means may be used for shortening or lengthening the head strap 28 as would be known to a person skilled in the art. In the preferred embodiment of the present invention, the head strap 28 is adjusted so that it is gently engaged with the back of the individual's head when the kayak is in the loaded position as hereinafter described.

In the preferred embodiment of the present invention, to allow the device of the present invention to be quickly disassembled for storage, the shoulder mounts 22 may be removed from the device when not in use. In one such embodiment of the present invention as illustrated in FIGS. 5 and 6, the shoulder mounts 22 preferably have welded or otherwise securely attached thereto, an insertion bar 23 the outer dimensions of the insertion bar 23 being slightly smaller than the internal dimensions of the square tubing which forms the main upright post 34 to allow the insertion bar 23 to readily slide inside the square tubing which forms the main upright post 34. In this embodiment of the present invention, a permanent magnet 25 has been securely and preferably permanently positioned within the main upright post 34 as illustrated in FIG. 6, and a preferably a screw 27 made of steel or other magnetically attractive material has been securely inserted into a corresponding threaded hole in the end of the insertion bar 23 as illustrated in FIG. 6, the permanent magnet positioned so that when the insertion bar 23 is fully inserted into the square tubing which forms the main upright post 34, the screw 27 comes into contact with and magnetically engages with the permanent magnet 25, the permanent magnet 25 being strong enough to prevent the shoulder mounts 22 from accidentally disengaging from the device 5.

In operation, prior to mounting the device 5 of the present invention, the center of gravity of the kayak 1 is determined, so that when the device 5 is installed on the kayak 1 as described herein, the device 5 is positioned so that the center of gravity of the kayak 1 is between and preferably substantially midway between the balance bar 2 and the axis defined by the longitudinal axis 31 of the load carrying rods 10. In one embodiment of the present invention, once the device 5 is properly positioned as described above, to install the device 5 onto the kayak 1, the wingnuts 12 and 18 (which wingnuts 12 and 18 are in threaded engagement with the threaded load carrying rod 10) are loosened and the clamps 13 opened sufficiently to permit the positioning of the coaming/gunwale 38 between the outer clamp element 37 and the inner clamp element 16. Once the coaming/gunwale 38 is properly positioned and aligned within the loosened clamps 13, the wingnuts 12 and 18 are tightened relative to one another to secure the outer clamp element 37 and the inner clamp element 16 to the outer and inner surfaces of the coaming/gunwale 38 respectively. Once both of the clamps 13 have been securely fastened to the coaming/gunwale 38, to raise the kayak into position, the individual lifts one end of the kayak off of the ground 7 (while the other end remains in contact with the ground 7), and thereafter rotates the kayak so that it is inverted, and thereafter positions the shoulder supports of the device of his/her shoulders. The kayak is then rotated (the rotation being shown by arrow 19A in FIG. 2) about the axis defined by the longitudinal axis 31 of the load carrying rods 10 (the outer clamp elements 37, outer clamp supports 14, inner clamp elements 16 and wingnuts 12 and 18 rotating with the clamped coaming/gunwale 38 about their respective load carrying rods 10) until the inverted kayak is in a horizontal or substantially horizontal orientation as shown in FIG. 1 with the head strap 28 positioned securely behind the individual's head.

In the preferred embodiment of the present invention, it is understood that the outer clamp elements 37, outer clamp supports 14, inner clamp elements 16 and wingnuts 12 and 18 provide sufficient rotational resistance to significantly reduce the fore and aft pivoting motion of the kayak once being supported and/or transported by the individual, on the one hand, and nevertheless permit some rotational movement of the kayak so that the kayak can be rotated during the lifting and unloading process described herein.

When the kayak and device of the present invention has been positioned on the individual's shoulders as described herein, to thereafter rotate the kayak about a substantially vertical axis, the individual may, by rotating his/her shoulders about a substantially vertical axis, thereby rotate the shoulder mounts 22 and the kayak 1 about the substantially vertical axis, the head strap 28 being used as necessary to assist the individual in controlling the kayak during this rotation.

When the kayak and device of the present invention has been positioned on the individual's shoulders as described herein, to control or resist some of the kayak and device's forward rotation about the threaded load carrying rods 10 and user's shoulders respectively (and to supplement the previously described rotational resistance provided by the outer clamp elements 37, outer clamp supports 14, inner clamp elements 16 and wingnuts 12 and 18) for example, when the individual carrying the kayak with the device 5 stops quickly, or when unloading the kayak as hereinafter described, as the head strap begins to rotate forward (in response to the rotation of the kayak and the device of the present invention attached thereto) and is pressed harder against the back of the individual's head, the individual may, by using his/her neck muscles, wholly or partially resist this pressure and thereby wholly or partially resist the forward rotation of the kayak and device.

Figure 2:
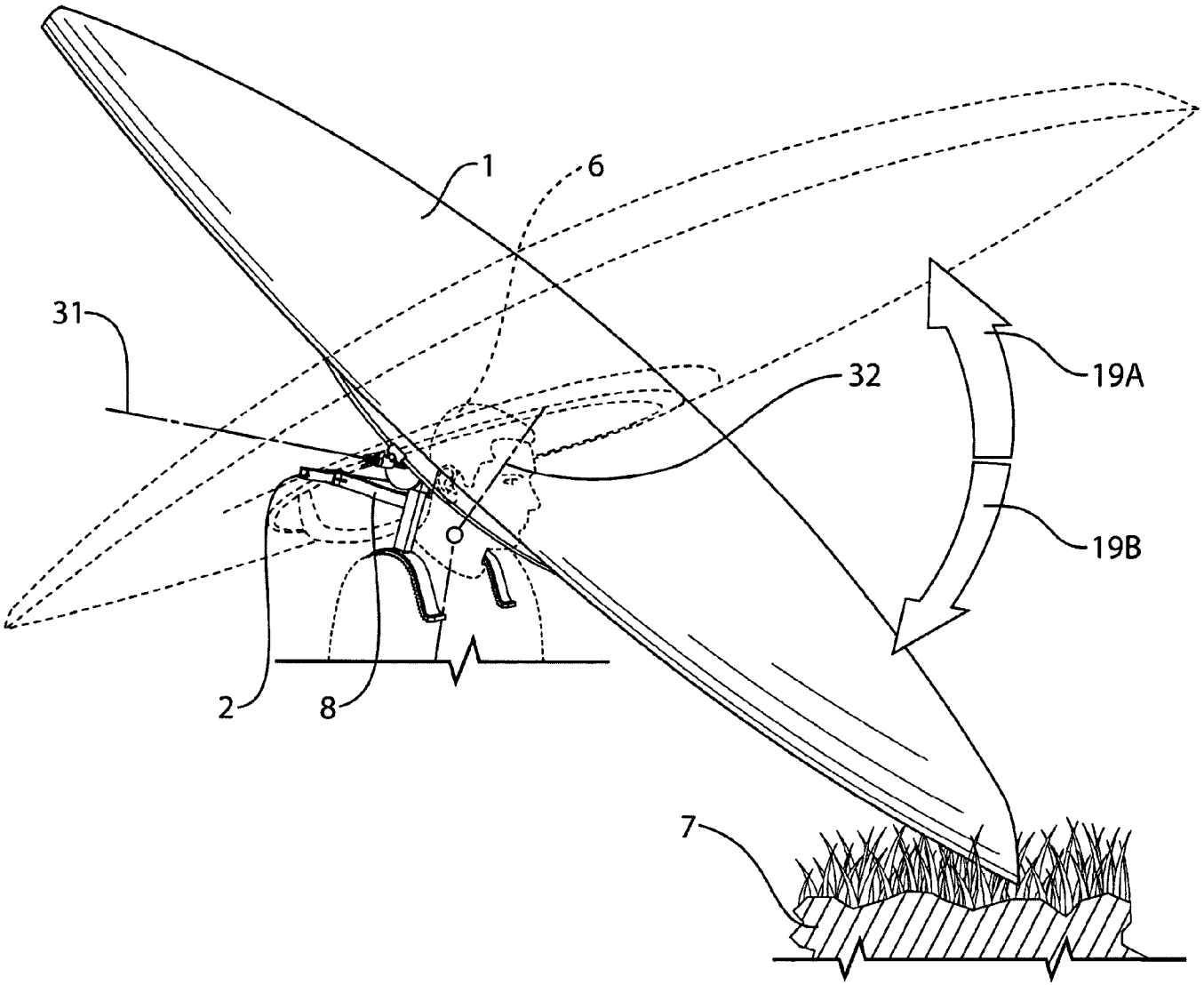
FIG. 2 is a view of an individual lifting or unloading a kayak utilizing a device of one embodiment of the present invention.

When unloading the kayak onto the ground, the kayak may be rotated forward (the rotation being shown by arrow 19B in FIG. 2) about the axis defined by the longitudinal axis 31 of the load carrying rods 10 (the outer clamp elements 37, outer clamp supports 14, inner clamp elements 16 and wingnuts 12 and 18 rotating with the clamped coaming/gunwale 38 about their respective load carrying rods 10), as illustrated in FIG. 2, and when the front of the kayak comes into contact with the ground, the individual may thereafter lift the kayak and device off of his/her shoulders, move to the rear of the kayak and thereafter lower it toward the ground, rotating the kayak to an upright position before laying the kayak on the ground. The device of the present invention may thereafter be removed from the kayak by loosening the clamps 13 (by loosening the wing nuts 12 and 18 on each of the clamps 13), and thereafter lifting the device away from the kayak. In the preferred embodiment of the present invention, the shoulder mounts 22 may be removed from the lower end of the main upright posts by gently pulling on the shoulder mounts with sufficient force to overcome the magnetic engagement of the screw to the magnet.

In one embodiment of the present invention, to increase the simplicity and speed of the installation of the device 5 onto, and removal of the device from the kayak 1, once the device 5 has been correctly installed on the kayak 1 as described above, thereafter, when removing the device 5 from the kayak 1, only the outer wingnuts 12 are loosened (the inner wingnuts 18 remaining stationary) until the outer clamp elements 37 are no longer in engagement with the coaming/gunwale 38, allowing the device 5 to be removed from the kayak 1. On the re-installation of the device 5 onto the same kayak 1, the inner clamp elements 16 and wingnuts 18 are already in the correct position for that kayak 1 (being pre-positioned from a previous installation, and thereafter remaining stationary during the previous removal), requiring the individual to merely correctly position the device 5 on the kayak 1, and thereafter tighten the outer wingnuts 12 until each of the outer clamp elements 37 are fully engaged with the coaming/gunwale 38 as previously described.

While the present embodiment of the invention has been described with reference to some components having been manufactured from aluminum tubing, aluminum square stock and other aluminum components, it is understood that in one embodiment of the present invention, these components may be manufactured from a wide range of different materials, such as plastic, fibreglass and other materials known to a person skilled in the art, with appropriate modifications as required to perform the functions described herein. Additionally, where necessary to modify the design of the present invention to accommodate the use of alternative materials, it is understood that additional strengthening elements, such as gussets may be utilized to provide the necessary strength to achieve the desired result as would be known to a person skilled in the art.

The present invention has been described herein with regard to preferred embodiments. However, it will be obvious to persons skilled in the art that a number of variations and modifications can be made without departing from the scope of the invention as described herein.

What is claimed is:

1. A device for lifting, supporting, transporting and unloading a kayak, comprising:

a. engagement means for releasably and securely engaging the coaming of the kayak;

b. support means for stably supporting the engagement means and engaged kayak on an individual's shoulders;

c. rotation means in engagement with the support means and the engagement means adapted to rotate the engagement means relative to the support means to permit rotational movement of the kayak during lifting and unloading by the individual;

d. resistance means adapted to provide sufficient rotational resistance to significantly reduce fore and aft pivoting motion of the kayak during hands-free transport by the individual;

e. a head strap mounted to the support means and adapted to be positioned securely behind the individual's head for interacting with a back portion of the individual's head, the head strap adapted for providing control of the fore and aft pivoting motion of the kayak during hands-free transport by the individual:

f. wherein said support means comprises:

a left hand side and a right hand side support post mounted to a left hand side and a right hand side shoulder mount, respectively;

a left hand side and a right hand side setback bar mounted to the left hand side and the right hand side support post, respectively; and, a balance bar adjustably mounted to the left hand side and the right hand side setback bar for connecting the left hand side and the right hand side support post behind the individual's head:

g. wherein the head strap is mounted to the left hand side and the right hand side support post:

h. wherein the setback bars position the balance bar behind the engagement means; and i. wherein the balance bar is positioned to support at least some of the weight of the kayak.

2. The device of claim 1, wherein said engagement means comprises a first member and a second member, wherein said first member and said second member are disposed in clamping relationship to secure the device to the coaming of the kayak, and including a load carrying rod, and wherein said first member and said second member are adjustable along said load carrying rod to provide a range of positions along the rod for securing said first member and said second member to said coaming.

3. The device of claim 2, wherein said load carrying rod is a threaded rod, and wherein said first member comprises a first threaded member and wherein said second member comprises a second threaded member, said first threaded member and said second threaded member being matingly threaded for positioning along said rod.

4. The device of claim 3, wherein at least one of said first member and said second member comprises an outer clamp having a concave-shaped outer clamp element.

5. The device of claim 4, wherein a pair of rods is provided, and wherein a first member and a second member are disposed on each rod of said rod pair so that said device comprises two first members and two second members.

6. A device according to claim 1 wherein the support means comprise a magnetic engagement/release mechanism for releasably and securely engaging shoulder mounts.

7. A device for lifting, supporting, transporting and unloading a kayak, comprising:

a. engagement means for releasably and securely engaging the coaming of the kayak;

b. support means for stably supporting the engagement means and engaged kayak on an individual's shoulders;

c. rotation means in engagement with the support means and the engagement means adapted to rotate the engagement means relative to the support means to permit rotational movement of the kayak during lifting and unloading by the individual; and, d. resistance means adapted to provide sufficient rotational resistance to significantly reduce fore and aft pivoting motion of the kayak during hands-free transport by the individual;

e. wherein the rotation means is securably carried with said engagement means and said support means;

f. a head strap mounted to the support means and adapted to be positioned securely behind the individual's head for interacting with a back portion of the individual's head, the head strap adapted for providing control of the fore and aft pivoting motion of the kayak during hands-free transport by the individual;

g. wherein said support means comprises:

a left hand side and a right hand side support post mounted to a left hand side and a right hand side shoulder mount, respectively;

a left hand side and a right hand side setback bar mounted to the left hand side and the right hand side support post, respectively; and, a balance bar adjustably mounted to the left hand side and the right hand side setback bar for connecting the left hand side and the right hand side support post behind the individual's head;

h. wherein the head strap is mounted to the left hand side and the right hand side support post;

i. wherein the setback bars position the balance bar behind the engagement means; and j. wherein the balance bar is positioned to support at least some of the weight of the kayak.

* * * * *